United States Patent [19]

Simmel et al.

[11] Patent Number: 4,924,921

[45] Date of Patent: May 15, 1990

[54] LIQUID DELIVERY/FILLING SYSTEM

[75] Inventors: Thomas L. Simmel; Craig A. Baker, both of Milford, Conn.

[73] Assignee: Link Racing, Inc., Milford, Conn.

[21] Appl. No.: 211,811

[22] Filed: Jun. 27, 1988

[51] Int. Cl.[5] ..... B67C 3/00; B65B 39/04

[52] U.S. Cl. ..... 141/286; 141/293; 141/295; 141/302; 141/305; 141/351; 141/354

[58] Field of Search ..... 141/285, 290, 291, 292, 141/293, 294, 295, 296, 302, 305, 308, 309, 310, 319, 320, 321, 351, 352, 353, 354, 286

[56] References Cited

U.S. PATENT DOCUMENTS

| | | | |
|---|---|---|---|
| 176,600 | 4/1876 | Covel | 141/309 |
| 245,401 | 8/1881 | Raynor et al. | 141/293 |
| 668,303 | 2/1901 | Beyer | 141/353 |
| 1,580,737 | 4/1926 | Kettelson | 141/309 |
| 2,272,208 | 2/1942 | Jorgensen | 141/294 |
| 2,401,674 | 6/1946 | Vizay | 141/294 |
| 2,628,759 | 2/1953 | Bodendoerfer | 141/293 |
| 3,139,123 | 6/1964 | Lisciani | 141/309 |
| 3,278,094 | 10/1966 | Perry | 141/291 X |
| 4,598,743 | 7/1986 | Milling | 141/296 |

FOREIGN PATENT DOCUMENTS

| | | | |
|---|---|---|---|
| 104680 | 8/1937 | Australia | 141/351 |
| 701374 | 1/1965 | Canada | 141/290 |
| 18492 | 8/1956 | Fed. Rep. of Germany | 141/285 |
| 845756 | 9/1939 | France | 141/285 |

*Primary Examiner*—Ernest G. Cusick

*Attorney, Agent, or Firm*—Mattern, Ware, Stoltz & Fressola

[57] ABSTRACT

By employing two independent, separate and distinct flow paths which are controllably sequentially opened during use in a single actuation operation, an error-free, flame and explosion proof liquid delivery/filling system is achieved. In the preferred embodiment, both flow paths are normally maintained in a closed, sealed configuration, requiring an actuation force to controllably, sequentially open the flow paths. Furthermore, the preferred embodiment is compact in design and provides an easy to use system, without sacrificing its inherent benefits. In addition, a flow diverging structure is mounted in the liquid flow path to assure complete removal of all of the air from the chamber being filled.

17 Claims, 4 Drawing Sheets

LIQUID DELIVERY/FILLING SYSTEM

BACKGROUND ART

For many years, safe, trouble-free delivery or transferral of various liquids, particularly flammable liquids, has long been a problem which has plagued the industry. In particular, in situations where small quantities of flammable liquids are to be transferred from a storage container to a active, useable reservoir, such as the gasoline tank of motor vehicles, the difficulties typically encountered with transferring flammable liquids become most acute.

In an attempt to reduce or eliminate these difficulties, various systems and adaptors have become available. However, these prior art systems have failed to eliminate the inherent danger or to overcome the problems and dangers.

The most severe problems being encountered are the spontaneous eruption of an uncontrolled fire and unwanted explosions often followed by fire. These catastrophic incidents have occurred most frequently in the rapid delivery of gasoline from a storage container to the tank or reservoir of a vehicle during an on-going race.

In such situations, particularly with racing cars, motorcycles and all terrain vehicles, speed of delivery is important. In addition, particularly with motorcycles, all terrain vehicles and small cars, the fuel tank size does not allow pressurized pump delivery systems. Consequently, gravity delivery is employed, with the desirability of high speed often leading to carelessness.

In these gravity-based delivery situations, it has been found that gasoline vapors build up in the storage container prior to use, particularly when the ambient temperatures are high or the storage tanks are left out in direct sunlight. During the rush to rapidly fill the gasoline tank for continued racing, the storage tank is inadvertently not vented prior to use. Consequently, the highly flammable, pressurized gasoline vapors are allowed to come into rapid contact with the hot motor vehicle, often causing an unwanted fire or explosion.

In addition, prior art delivery systems have failed to eliminate unwanted spillage. Consequently, gasoline is often spilled on the hot motor vehicle during the delivery process. This spillage is also very dangerous and has also resulted in unwanted fires.

Although these problems and difficulties have existed in the industry for many years, no prior art system exists which completely eliminates the inherent dangers found in these fuel delivery situations.

Therefore, it is a principal object of the present invention to provide a liquid delivery/filling system which is capable of controllably delivering liquid fuel to a tank or container in a safe, error free manner.

Another object of the present invention is to provide a liquid delivery/filling system having the characteristic features described above which provides positive, automatic flow control means to assure that the liquid is being delivered only when safe to do so.

Another object of the present invention is to provide a liquid delivery/filling system having the characteristic features described above which substantially reduces any chance of fires or explosions during the gravity delivery of liquid fuel from one reservoir to another.

Another object of the present invention is to provide a liquid delivery/filling system having the characteristic features described above which virtually eliminates dangerous spillage of the fuel being delivered.

Other and more specific objects will in part be obvious and will in part appear hereinafter.

SUMMARY OF THE INVENTION

The present invention overcomes prior art difficulties by providing two separate and distinct flow channels both of which are controllably opened in a specific, pre-set sequence, upon actuation. In this way, the liquid delivery/filling system of the present invention assures that upon actuation the liquid fuel is safely delivered from the first storage reservoir to the second active reservoir, while being completely closed prior to actuation.

By providing two completely independent and separate flow channels, the liquid fuel is controllably delivered along one flow path or channel, while the second flow path or channel assures controlled removal of displaced air from the chamber being filled. In addition, the air is delivered to a zone above the liquid fuel level. This prevents unwanted air flow or bubbling through the liquid fuel itself, thereby eliminating one primary source of spillage.

Furthermore, by mounting the system in a normally closed position and providing the sequential controlled actuation of the two independent flow channels when desired, the liquid delivery/filling system of the present invention eliminates the second source of spillage, as well as safely controlling any vapor build up in the storage container. The present invention substantially reduces any possibility that vapor pressure build up will be accidentally ignited or that fuel will be spilled in unwanted or undesirable areas.

In the preferred construction, the two, independent, flow channels are constructed concentrically, in order to provide a compact and easily useable construction. In addition, the controlled, sequential actuation is achieved in a positive, automatic error free manner. As a result, regardless of user knowledge, trouble-free use is attained.

Furthermore, the liquid delivery/filling system of the present invention incorporates flow shut-off means which automatically discontinues the delivery of the fuel to the active reservoir when the reservoir has been filled. By incorporating automatic flow shut-off means, in combination with the other features detailed above, the fluid delivery/filling system of the present invention provides for the safe transferral or delivery of flammable liquids, without the dangers and problems that have plagued the industry.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
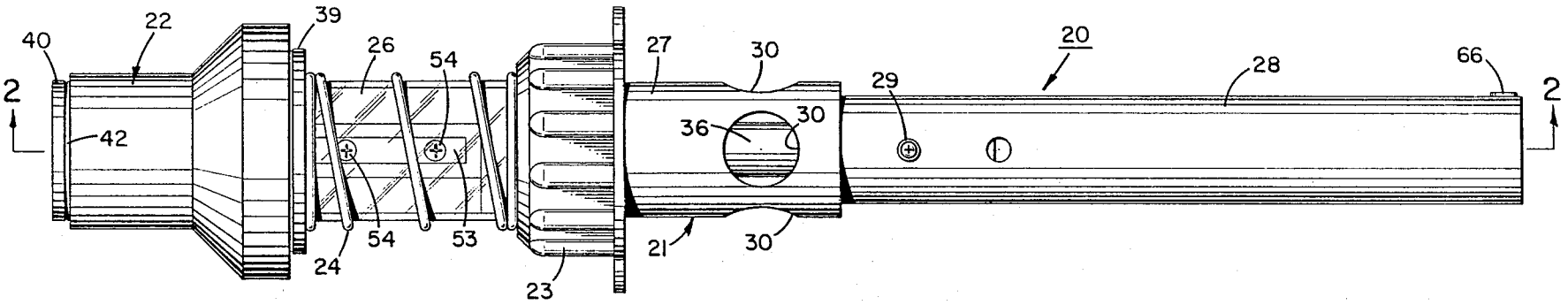
FIG. 1 is a side elevational view of the fluid delivery/filling system of the present invention shown fully assembled, and in its normally closed position.

As shown in FIG. 1, the liquid delivery/filling system 20 of the present invention comprises an elongated, outer tube 21 to which is mounted a slidable collar 22 and a sealing cap 23. In addition, coil spring 24 is mounted about tube 21 between collar 22 and cap 23 to maintain slidable collar 22 in its fully extended, forwardmost flow sealing position.

Figure 2:
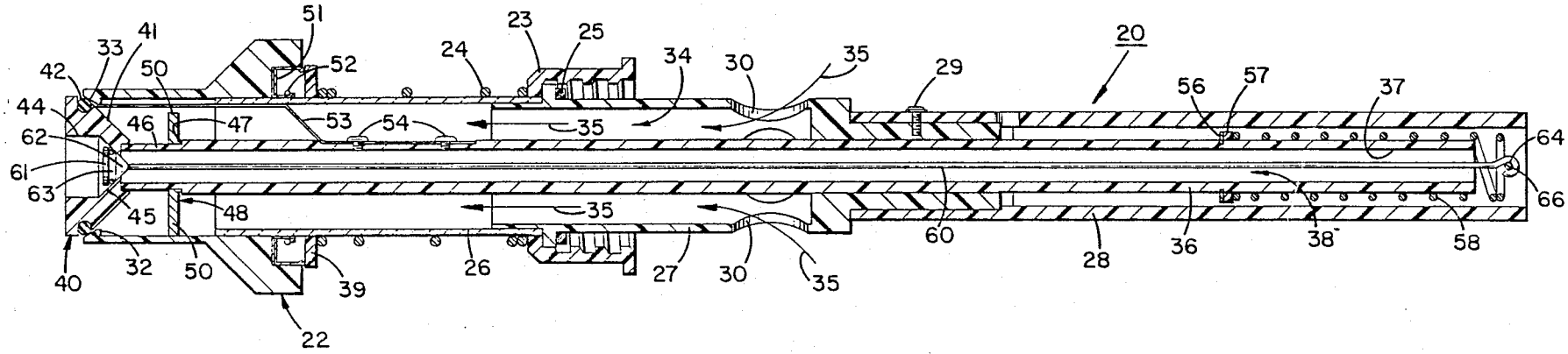
FIG. 2 is a cross-sectional side elevational view of the liquid delivery and filling system of the present invention taken along line 2—2 of FIG. 1.
Figure 3:
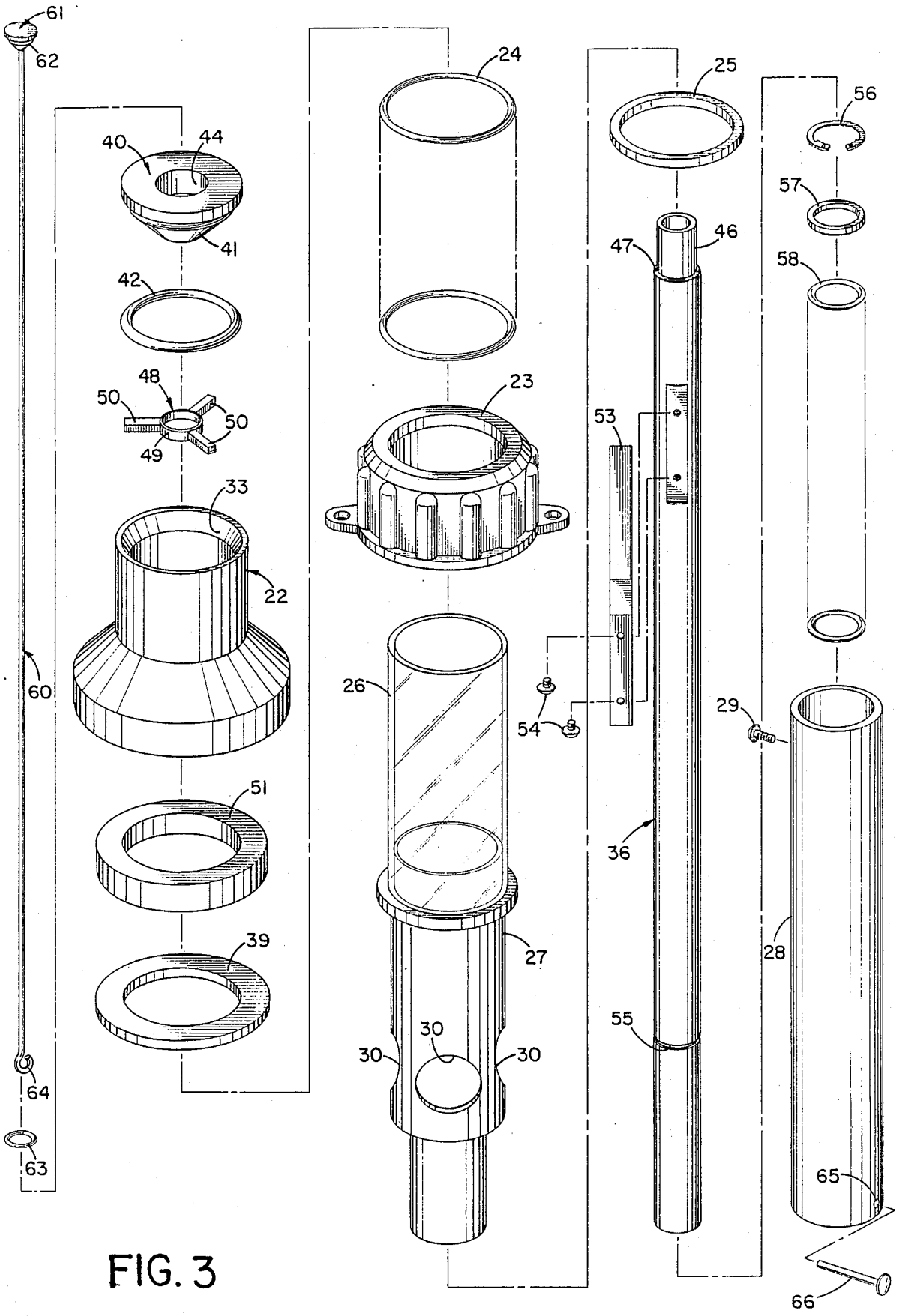
FIG. 3 is an exploded perspective view of the fluid delivery/filling system of the present invention.

By referring to FIGS. 2 and 3, along with FIG. 1, in conjunction with the following detailed disclosure, the overall construction of liquid delivery/filling system 20 can best be understood. In the preferred construction, elongated outer tube 21 comprises three component parts. These components preferably comprise a clear, transparent section 26, a central section 27, to which transparent section 26 is fixedly mounted, and a distal section 28 which is removably mounted to central section 27 by screw means 29. In this way, distal section 28 can comprise alternate lengths, in order to cooperate with storage containers of any configuration.

In this preferred embodiment, central section 27 of elongated outer tube 21 incorporates a plurality of portals 30 formed therein. As is more fully detailed below, tube 21 defines flow path 34 along which the liquid to be transferred from the first container to the second container travels in the general direction shown by arrows 35.

In addition to outer elongated tube 21, liquid delivery/filling system 20 of the present invention also incorporates an inner elongated tube 36. Preferably, elongated tube 36 comprises an overall length which is less than the overall length of outer tube 21. Furthermore, tube 36 is preferably concentrically mounted within elongated tube 21 as well as being slidably engaged therewith.

Inner elongated, slidably engaged tube 36 incorporates a centrally disposed, elongated bore 37 extending the entire length thereof and defining a second flow path 38 for liquid delivery/filling system 20.

At the proximal end of inner elongated tube 36, a liquid flow controlling valve 40 is securely affixed. In the preferred embodiment, valve 40 comprises a generally annular shape having a conically shaped base. As a result, valve 40 comprises an outer conical shaped surface 41, the apex end of which is securely affixed to the proximal end of tube 36. At the opposed end of conical shaped surface 41, a sealing O-ring 42 is mounted. In addition, valve 40 comprises a portal 44 and an inner conical shaped surface 45.

As clearly shown in FIG. 2, when slidable collar 22 is in its forward-biased, flow preventing position, the sloping, ramped surface 33 of collar 22 is maintained in secure, engaged, sealing contact with O-ring 42. Furthermore, collar 22 is normally held in this position by spring means 24, assuring that liquid flow through passageway 34 is prevented.

In order to prevent unwanted leakage of the liquid being transferred between the storage container and the active reservoir, slidable collar 22 incorporates a sealing ring assembly 51 securely affixed to collar 22 at the distal end thereof. In addition, sealing ring assembly 51 incorporates a coil spring 52 mounted therein which maintains a portion of sealing ring assembly 51 in biased frictional engagement with transparent section 26 of elongated tube 21. In this way, when collar 22 is in its forwardly biased sealed configuration, leakage of the liquid contained in passageway 34 is prevented.

In addition, in order to assure continuous, troublefree axial slidability of collar 22 along transparent section 26, a washer 39 is mounted between collar 22 and spring means 24. In this way, washer 39 provides a bearing surface upon which compression spring 24 acts, as well as a solid surface for acting upon spring 24 as collar 22 is axially moved distally against the forces of spring 24.

As clearly shown in FIGS. 2 and 3, the proximal end of inner elongated tube 36 incorporates a reduced diameter section 46, which terminates with layer diameter ledge 47 of elongated tube 36. In addition, movement control means 48 is mounted about reduced diameter section 46 and is constructed for slidable engagement therealong. In this way, movement control means 48 is free to slide along reduced diameter section 46 between flow controlling valve 40 and ledge 47.

In the preferred embodiment, movement control means 48 comprises a central, substantially circular ring 49 and three, substantially equal length arms 50 extending radially outwardly from the outer surface of ring 49. Preferably, the length of each arm 50 is sufficient to extend arm 50 substantially to the inner diameter surface of slidable collar 22. In this way, flange 32 of collar 22 overlaps the terminating ends of arms 50 and is able to be moved into contacting engagement with the terminating ends of arm 50.

Inner elongated tube 36 also comprises, in the preferred embodiment, an elongated substantially flat metal plate member 53 securely mounted to the outer peripheral surface of elongated tube 36 by screw means 54. As is more fully detailed below, elongated, plate member 53 serves as a flow deflector for the liquid being transferred from the first storage container to the active reservoir.

Furthermore, towards the distal end of tube 36, a locking ring 56 is securely mounted in recess 55, with a washer 57 mounted adjacent thereto. Finally, coil spring 58 is mounted about the distal end of elongated tube 36, with one end of said coil spring 58 being engaged with washer 57, held in that position by locking ring 56.

The final major component incorporated in liquid filling/delivery system 20 of the present invention is elongated rod 60 which is mounted substantially along the central axis of liquid delivery/filling system 20. In the preferred construction, the overall length of rod 60 is greater than the overall length of inner elongated tube 36, while being less than the overall length of outer elongated tube 21. In addition, at the proximal end of rod 60, an air flow controlling valve 61 is securely affixed. Valve 61 incorporates a flow controlling, substantially conical shaped surface 62, the apex of which is securely affixed to the proximal end of rod 60. At the opposed end of conical surface 62, a sealing O-ring 63 is mounted.

As discussed above, flow controlling valve 40 comprises a substantially annular shape with a substantially centrally disposed portal 44 terminating with a ramped, substantially conical shaped surface 45. As shown in FIG. 2, flow controlling valve 61 is constructed for mating, flow controlling engagement with conical surface 45 of liquid flow controlling valve 40, with O-ring 63 of air valve 61 securely engaging with conical surface 45 when valve 61 is in its closed position. In this way, any flow of air through passageway 38 is prevented.

At its distal end, elongated rod 60 is preferably formed in a substantially hook shape to define an eyelet passageway 64. In addition, distal portion 28 of elongated outer tube 21 incorporates diametrically aligned through holes 65 through which pin 66 is securely mounted. As shown in FIG. 2, pin 66 passes through eyelet 64 of shaft 60, thereby securing shaft 60 in a substantially fixed, immovable position. Furthermore, coil spring 58, which abuts ring 57 at one end thereof is maintained in position with pin 66 holding the opposed end thereof under compression.

As detailed above, spring 58 is maintained under compression between pin 66 and ring 57. Since ring 57 securely abuts centrally mounted ring 56, the force of spring 58 causes elongated tube 36 to be pushed away from pin 66. However, since the axial movement of tube 36 is restricted by air flow controlling valve 61 mounted at the distal end of shaft 60, the combination of these elements causes passageway 38 of elongated tube 36 to be normally maintained in the closed, sealed configuration with flow controlling valve 61 and mating surfaces 44 of flow controlling valve 40 being held in secure sealed abutting engagement by compression spring 58.

As is apparent from the foregoing detailed description, liquid delivery/filling system 20 of the present invention is normally maintained in its completely sealed configuration, with both air flow controlling valve 61 and liquid flow controlling valve 40 being held in their closed position, preventing any flow through the two independent flow channels associated therewith. However, as detailed below, when liquid delivery/filling system 20 of the present invention is activated, flow controlling valves 40 and 61 sequentially open, in a controlled manner, assuring that any unwanted liquid spillage or vapor pressure build up is not released in a manner that could lead to a dangerous situation.

Figure 4:
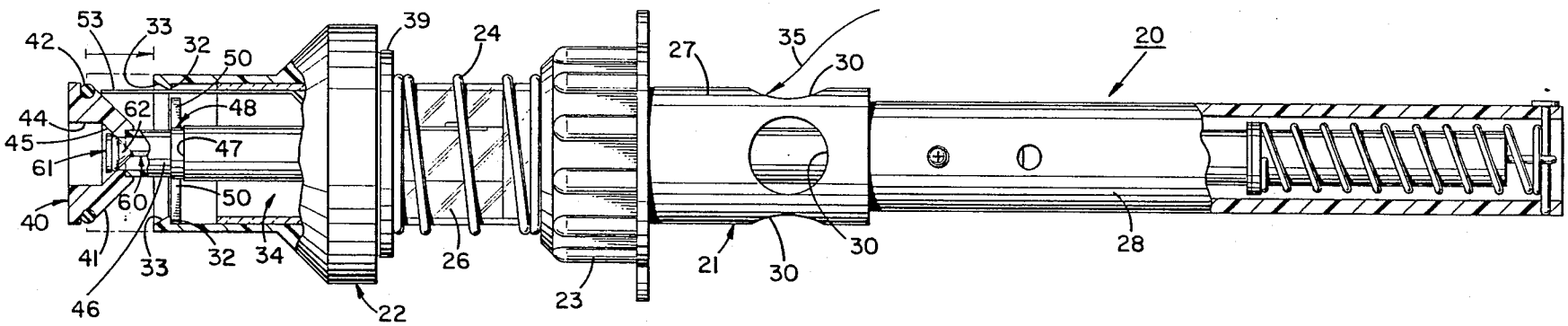
FIG. 4 is a side elevational view, partially in cross-section and partially broken away, of the fluid delivery and filling system of the present invention shown in its partially open position.
Figure 5:
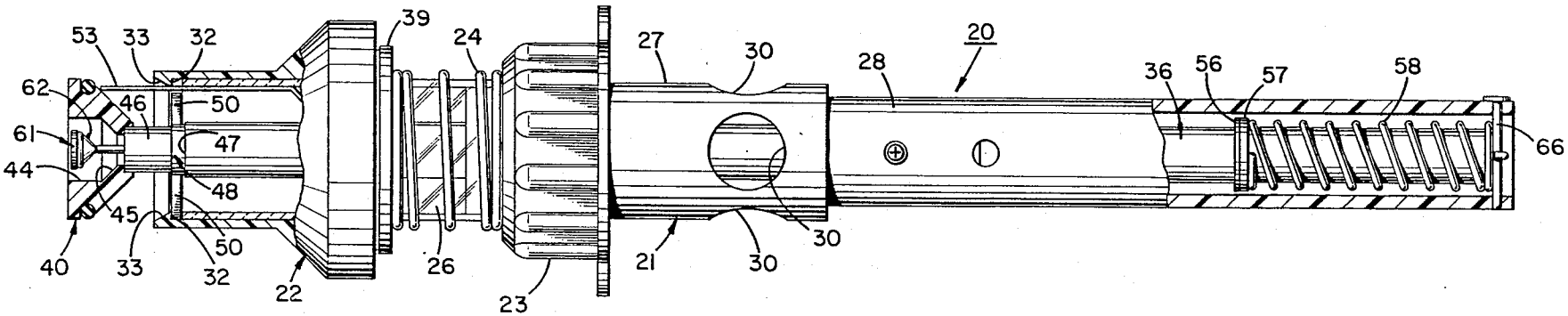
FIG. 5 is a side elevational view, partially in cross-section and partially broken away, of the fluid delivery/filling system of the present invention shown in its fully open position.

By referring to FIGS. 4 and 5, along with the following detailed disclosure, the sequential opening of flow paths 34 and 38 can best be understood. In addition, as is more fully detailed below, it is apparent that in normal use, cap 23 would be mounted to a liquid storage container with its associated O-ring 25 sealingly mounted with the container to prevent unwanted leakage. However, for purposes of clarity in the following explanation, liquid delivery/filling system 20 of the present invention is shown in FIGS. 4 and 5 without any associated storage container.

Before activating the liquid delivery/filling system 20 of the present invention by slidably moving collar 22, filling system 20 would be inserted into the active container or reservoir into which the liquid is to be transferred. This would be achieved by positioning funnel shaped collar 22 in the receiving aperture of the container or reservoir into which the liquid is to be transferred. For this reason, collar 22 is constructed with the overall funnel shape, with the outer diameter of the proximal end thereof being designed for easily fitting into the liquid receiving aperture formed in the normally used reservoirs.

In initially activating system 20 of the present invention, the user would slide collar 22 axially toward the distal end thereof, causing the compressive force of spring 24 to be increased.

As collar 22 is axially moved toward the distal end of system 20, ramped sealing surface 33 of collar 22 is removed from sealing engagement with O-ring 42 of flow controlling valve 40, thereby opening flow path 34 of outer tube 21. Once open, the liquid contained in the storage container is free to flow into portals 30 of central section 27 of elongated tube 21 through flow path 34 and out of system 20, passing between conical surface 41 of flow controlling valve 40 and ramp surface 33 of collar 22.

In addition, as collar 22 is axially moved distally, flange 32 of collar 22 captures arms 50 of movement control means 48. Regardless of the particular position movement control means 48 may be in movement control means 48 is captured by flange 32 and is moved axially along surface 46 until abutting ledge 47. As shown in FIG. 4, throughout this movement, inner elongated tube 36 remains in secure spring-biased engagement with air flow controlling valve 61, preventing any flow through path 38 associated therewith.

As a result, any high pressure, volatile vapors that may have built up in the storage container being dispensed is safely released directly into the container being filled, along with the liquid also stored in the container. Furthermore, during this initial actuation sequence, only the liquid flow path is open, thereby allowing only the liquid from the container to be dispensed with the high pressure volatile vapors that may have built up in the container merely causing added pressure on the liquid being dispensed, pushing the liquid more rapidly out of the container and into the reservoir to be filled. In this way, any dangerous result that might otherwise have occurred from the release of this volatile high pressure vapor is eliminated, by rendering the higher pressure harmless and, in fact, using the increased pressure to an advantage and more rapidly dispensing the liquid into the desired container.

Once the liquid flow channel or passageway 34 has been open, as detailed above, the continued sliding advance of collar 22 along proximal section 26 of elongated tube 21, with collar 22 advancing towards cap 23 in continued opposition to the compression force exerted by spring 24, the liquid delivery/filling system 20 of the present invention automatically causes the second passageway 38 to be opened.

As detailed above, when liquid carrying channel or passageway 34 is fully opened, movement control means 48 is captured between flange 32 of collar 22 and ledge 47 of inner elongated tube 36. As collar 22 is moved further towards the distal end of the delivery/filling system 20, the additional movement of collar 22 causes inner, elongated tube 36 to be axially moved in its entirety toward the distal end of system 20, until the distal end of elongated tube 36 comes into direct contact with pin 66, and arms 50 of movement control means 48 is sandwiched between flange 32 of collar 22 and the proximal edge of transparent section 26 of tube 21. As clearly shown in FIG. 5, the axial movement of elongated tube 36 into abutting contact with pin 66 causes spring 58 to be further compressed between pin 66 and ring 57.

Furthermore, the axial sliding movement of elongated tube 36 also causes the conical shaped surface 45 of liquid flow controlling valve 40 to become disengaged from sealing contact with conical surface 62 of air flow controlling valve 61. As a result, air flow passageway 38 of elongated tube 36 is open, allowing the air contained in the reservoir being filled to be automatically channeled through passageway 38, while the liquid entering the reservoir freely flows through passageway 34 of outer elongated tube 21.

As is readily apparent from the preceding detailed disclosure, the liquid delivery/filling system 20 of the present invention automatically achieves sequential, controlled actuation of a liquid flow path and a separate, independent air flow path in a precise trouble-free controlled manner.

By providing the sequential, controlled actuation of a liquid flow channel or passageway and a separate, independent air flow channel or passageway, a liquid delivery/filling system is attained which eliminates the prior art problems and difficulties encountered in transferring volatile liquids from one container to an active reservoir. By employing the delivery/filling system of the present invention, all flow of the volatile liquid is prevented until specifically initiated by the user, with any pressure built up in the storage container being used to the system's advantage free of any harm or unwanted spillage or contact with hot surfaces.

Furthermore, once the volatile liquid flow has been initiated, the air flow passageway is automatically opened to allow the liquid entering the active reservoir to easily displace the air contained in the reservoir, while the air is safely channeled into the storage container in a completely separate flow channel which delivers the air to the area of the container which is furthestmost from the exit portal for the volatile liquid. This construction is most clearly shown in FIG. 6, wherein the liquid delivery/filling system 20 of the present invention is shown in one typical system in actual use.

Figure 6:
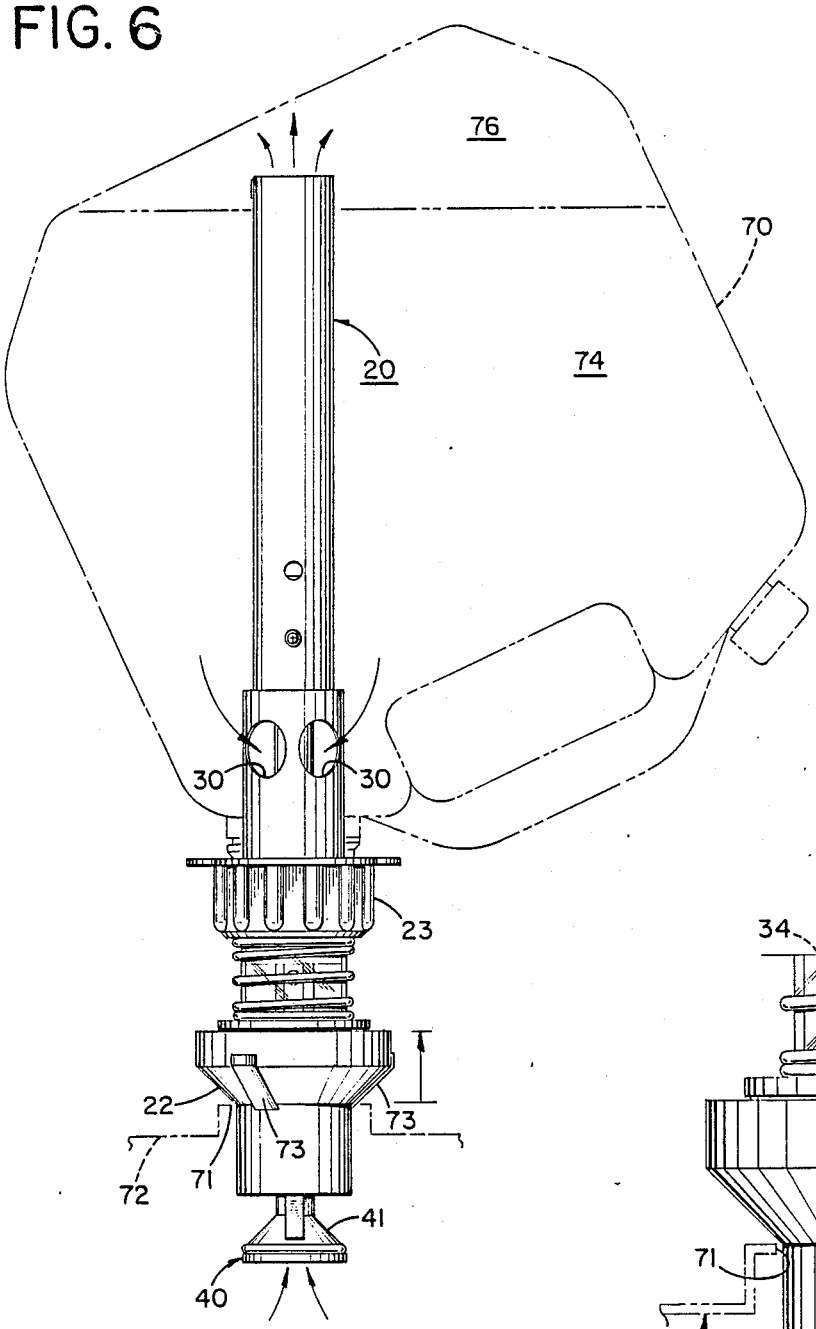
FIG. 6 is a diagrammatic view, partially in cross-section and partially broken away showing the liquid delivery/filling system of the present invention in use transferring fluid from one reservoir into another.

As depicted in FIG. 6, liquid delivery/filling system 20 of the present invention is securely affixed to a conventional liquid storage tank 70, with cap 23 threadedly engaged to container 70 in sealing contact therewith, preventing any unwanted leakage. Furthermore, funnel shaped collar 22 is inserted into the open mouth 71 of reservoir 72 into which the liquid 74 in storage container 70 is to be transferred. As clearly shown in FIG. 6, liquid 74 is easily emptied from container 70, since portals 30 are positioned near the mouth of container 70. In this way, all the liquid 74 stored in container 70 can be removed therefrom and transferred to reservoir 72.

In the embodiment shown in FIG. 6, funnel-shaped collar 22 incorporates a plurality of optional ribs 73, extending from the outer conical funnel-shaped surface thereof. By employing ribs 73, the funnel-shaped surface of collar 72 is prevented from forming a complete seal with mouth 71 of reservoir 72. Instead, air gaps are established between mouth 71 and the funnel-shaped surface of collar 22 adjacent the plurality of ribs 73. As a result, by using this embodiment, any vapor pressure build-up within reservoir 72 is safely dissipated through the gaps formed between mouth 71 and the funnel-shaped surface of collar 22, without causing any adverse effects.

In addition, the distal end of system 20 is clearly shown to extend to the furthestmost location of container 70. In this way, the distal end of system 20 extends into the region above the liquid level, in order to allow the delivery of the air displaced from reservoir 72 into an air zone 76 above liquid level 74 of container 70. In this way, the displaced air is not forced to bubble through the liquid being delivered which typically causes irregular flow patterns for the liquid as well as potential spilling or uncontrolled liquid flow. By employing the present invention, these adverse flow patterns are completely eliminated and a free flowing safe flow path is achieved for liquid 74 as it is transferred from container 70 into reservoir 72.

The free flow of the liquid 74 from container 70 continues in a manner described above, with the displaced air passing around air control valve 61 through passageway 38 of inner elongated tube 36 until reservoir 72 is almost completely full. From the time the liquid begins flowing until container 72 is almost completely full, liquid 74 flows through passageway 34 of elongated tube 21 with the liquid flowing out of collar 22 between the inner surface thereof and the outer conical surface 41 of liquid flow control valve 40.

This free, rapid, controlled flow of liquid 74 with the controlled independent transferral of the displaced air through passageway 38 of inner elongated tube 36 continues until the liquid level in container 72 reaches the proximal edge of liquid flow control valve 40. At this time, air can no longer freely flow through elongated tube 36, since the liquid level in reservoir 72 has effectively sealed the opening to passageway 38. However, in order to allow all of the liquid in container 70 to be added to reservoir 72, the liquid delivery/filling system 20 of the present invention incorporates deflector 53.

Figure 7:
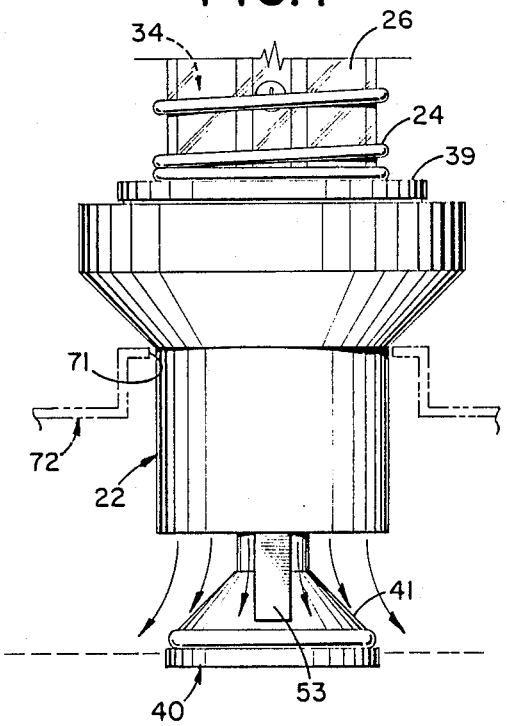
FIG. 7 is a side elevational view of the liquid delivery/filling system of the present invention shown in operation as the tank being filled nears completion.

As shown in FIG. 7, the liquid freely flows through collar 22, between the inner surface thereof and the conical outer surface 41 of liquid flow control valve 40 even when air can no longer flow through passageway 38. Without deflector 53, a complete conical shaped flow path would be established and the displaced air could not escape. However, with deflector 53, the liquid is prevented from completing a full conical shape. Instead, an open path is formed by deflector 53. As a result, air which is incapable of now passing through passageway 38 of tube 36 can pass in the reverse direction, through passageway 34 of tube 21, due to the opening provided in the conical flow path by deflector 53.

In the preferred embodiment, proximal section 26 of elongated outer tube 21 comprises transparent material. In this way, the user of system 20 can easily see the air exiting through passageway 34 by the bubbling effect visual through proximal section 26. As a result, the operator knows that reservoir 72 is substantially filled and flow will soon cease completely or, if desired, can be manually terminated by removing system 20 from reservoir 72.

It has also been found that by eliminating deflector 53, the unbroken, continuous, conical shaped flow pattern achieved by the liquid delivery/filling system 20 of the present invention operates efficiently to fill reservoir 72 up to the leading edge of valve 40. However, when the air can no longer flow through passageway 38 of inner elongated tube 36, flow automatically ceases.

As a result, the preferred embodiment of system 20 incorporates deflector 53. However, if desired, a delivery system can be constructed without deflector 53.

With deflector 53 in place, free flow of liquid 74 from container 70 continues until either all of the liquid has been removed from container 70 or, until, the liquid 74 in reservoir 72 has reached the proximal edge of collar 22. If the liquid 74 fills up to the proximal edge of collar 22, further flow of the liquid will be prevented. At this time, liquid delivery/filling system 20 would be removed from reservoir 72 and the vehicle being filled can be returned to operation.

Upon removal of liquid delivery/filling system 20 from its fully open, free flowing position, as depicted in FIG. 5, the system is automatically returned to the completely sealed configuration, shown in FIG. 2. As is apparent from the preceding detailed disclosure, coil spring 58 forces inner elongated tube 36 towards the proximal end of system 20, bringing air flow controlling valve 61 into sealing engagement with conical surface 45 of liquid flow controlling valve 40.

In addition, coil spring 24 forces collar 22 forward, toward the proximal end of system 20, bringing ramped surface 33 of collar 22 into abutting, sealing engagement with O-ring 42 and conical surface 41 of liquid flow control valve 40. In this way, system 20 is automatically returned to its sealed configuration, with both independent flow channels 34 and 38 completely closed, with system 20 remaining in this configuration until manually activated for future use.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A liquid delivery/filling system constructed for attachment to the sole portal of a first portable, independent storage container for transferring a desired liquid from the portable storage container to an active reservoir, the reservoir having a single inlet spaced away from the sidewalls thereof, for filling the reservoir in a controlled manner with overfilling being prevented and pressure build up in said storage reservoir controllably dispersed, said system comprising A. a first liquid flow channel for delivering a substantially conically shaped liquid flow;

B. a second, separate and independent flow channel positioned for cooperative association with said first liquid flow channel;

C. actuation control means cooperatively associated with said first flow channel and said second flow channel for sequentially opening the first liquid flow channel prior to opening said second flow channel whenever said control means is activated; and D. liquid flow interrupting means a. extending through the conically shaped flow established by the liquid as the liquid is being transferred from the storage container to the active reservoir, and b. creating an open zone extending completely through conically shaped liquid flow for allowing air displaced by the liquid entering the active reservoir to continuously exit from the active reservoir during the entire filling process.

whereby pressure build up in said first storage container is safely dispersed into said second active reservoir and uninterrupted, continuous, liquid flow is established without spillage thereof, eliminating the need to use the sidewalls of the active reservoir to control the liquid flow.

2. The liquid delivery/filling system defined in claim 1, wherein the liquid is further defined as comprising a flammable, highly volatile liquid.

3. The liquid delivery/filling system defined in claim 2, wherein both the first and second flow channels are further defined as being positioned concentrically to each other.

4. The liquid delivery/filling system defined in claim 3, wherein both the first and second flow channels are further defined as being normally maintained in a closed, sealed configuration, requiring the application of an actuation force to open said flow channels.

5. A liquid delivery/filling system constructed for attachment to the sole portal of a first portable, independent storage container for transferring a desired liquid from the portable storage container to an active reservoir, the reservoir having a single inlet spaced away from the sidewalls thereof, for filling the reservoir in a controlled manner with overfilling being prevented and pressure build up in said storage container controllably dispersed, said system comprising A. mounting means affixed to said system for sealingly securing said system to the sole portal of the independent, portable storage container thereby creating a sealed liquid holding container, with the system forming the sole exit means for the liquid held in the container;

B. a first elongated tube member a. defining a liquid flow path extending from the inside of the storage container to the outside thereof when the system is mounted to the container, and b. comprising a reservoir inlet engaging portion constructed for being inserted into the reservoir inlet for establishing a flow path independent of the sidewalls of the reservoir;

C. a second elongated tube member a. defining a second flow path extending from the inside of said storage container to the outside thereof when the system is mounted to the container; and b. axially aligned, substantially concentrically with said first tube member;

c. comprising a diameter smaller than said first tube member and being mounted co-axially therewith for longitudinal sliding relative thereto; and d. being normally biased into engagement with said second flow-controlling valve for maintaining the second flow path closed; and D. a first liquid flow-controlling valve positioned for cooperative association with one end of said first tube member, and normally maintaining said liquid flow path in a closed, flow preventing configuration;

E. a second flow-controlling valve positioned for cooperative association with one end of said second tube member, and normally maintaining said second flow path in a closed, flow preventing configuration; and F. actuation means a. comprising an axially movable collar mounted to the first elongated tube member, b. also comprising movement control means mounted to the second tube member and having 1. limited, free axial movement along a portion of said second tube member, and 2. control of said second tube member for effecting axial movement of said second tube member against said biasing force, and c. responsive to an actuation force to 1. sequentially open said first liquid flow path, 2. allow gravity to initiate the liquid flow from the storage container to the active reservoir, and 3. sequentially open said second flow path subsequent to said first flow path;

whereby pressure build up in the storage container is safely dispersed and continuous, uninterrupted liquid flow is established without any spillage thereof prior to the opening of the second flow path and without having the liquid flow slowed or stopped.

6. The liquid delivery/filling system defined in claim 5, wherein said collar is further defined as 1. being biased into engagement with the first flow controlling valve, and 2. incorporating a surface for contacting and controllably moving the movement control means through both its limited axial travel along the length of said second tube member and its controlled axial movement of said second tube member.

7. The liquid delivery/filling system defined in claim 6, wherein said collar is further defined as comprising an overall funnel shape to assure ease of positioning and securement of said collar in the mouth of the active reservoir.

8. The liquid delivery/filling system defined in claim 7, wherein said collar further comprises a plurality of ribs extending from the funnel-shaped surface thereof to prevent sealing engagement of the collar with the mouth of the active reservoir and, thereby, establish passageways for releasing vapor pressure build-up.

9. The liquid delivery/filling system defined in claim 8, wherein said first storage container portal is further defined as being threaded and said mounting means is further defined as comprising a threaded rotatable collar constructed for mating, sealing, removable interengagement with the threaded portal of the first portable independent storage container.

10. The liquid delivery/filling system defined in claim 6, wherein said collar is further defined as being normally biased into engagement with the first liquid flow-controlling valve to assure that said liquid flow path is normally maintained closed along with said normally closed second flow path, whereby said system is maintained in a closed, flow preventing configuration to assure positioning of said system with said active reservoir before any actual liquid flow commences.

11. The liquid delivery/filling system defined in claim 10, wherein said system is further defined as comprising G. an elongated rod positioned concentrically with said first tube member and said second tube member substantially along the central axis thereof with the second valve securely affixed at a first terminating end thereof.

12. The liquid delivery/filling system defined in claim 11, wherein said first tube member is further defined as comprising an overall length greater than the overall length of the second tube member, the second tube member is further defined as comprising biasing means, and said system further comprises pin means for holding the second terminating end of the elongated rod and establishing an abutment surface for one end of the biasing means of said second tube member.

13. The liquid delivery/filling system defined in claim 12, wherein said pin means further defines an abutment surface for terminating the axial movement of said second tube member.

14. The liquid delivery/filling system defined in claim 13, wherein the forward end of said collar and said first flow controlling valve define the liquid flow path exiting the liquid delivery/filling system.

15. The liquid delivery/filling system defined in claim 6, wherein said system further comprises G. a flow deflector mounted to the second tube member and extending into the liquid flow path adjacent the collar, thereby providing a secondary air flow path for allowing air displaced by the liquid entering the active reservoir to exit from the active reservoir even when the second flow path has been closed by the liquid transferred into said active reservoir.

16. The liquid delivery/filling system defined in claim 5, wherein said mounting means is further defined as being removable mounting means for allowing the liquid delivery/filling system of the present invention to be removed from the first portable independent storage container for cleaning and refilling thereof.

17. The liquid/delivery/filling system defined in claim 5, wherein the axially movable collar is further defined as being sealingly mounted to the first elongated tube member, thereby preventing unwanted leaks of the liquid being transferred.

* * * * *